US005191690A

United States Patent [19]

Koehn

[11] Patent Number: 5,191,690

[45] Date of Patent: Mar. 9, 1993

[54] BRAKE TOOL

[76] Inventor: Robert S. Koehn, 24940 Monroe St., Kansasville, Wis. 53139

[21] Appl. No.: 864,558

[22] Filed: Apr. 7, 1992

[51] Int. Cl.[5] ..... B25B 27/14

[52] U.S. Cl. ..... 29/275

[58] Field of Search ..... 29/229, 225, 243.56, 29/255, 270, 275, 278, 280, 282

[56] References Cited

U.S. PATENT DOCUMENTS

| | | | |
|---|---|---|---|
| 1,201,997 | 10/1916 | Close | 29/275 |
| 1,956,634 | 5/1934 | Watson | 29/275 |
| 2,089,902 | 8/1937 | Kulp | 29/275 |
| 2,521,186 | 9/1950 | Pennella | 29/275 |
| 2,876,531 | 3/1959 | Brauer | 29/229 |
| 3,057,052 | 10/1962 | Robertson | 29/275 |
| 3,099,876 | 8/1963 | Lawless | 29/229 |
| 4,188,722 | 2/1980 | Young | 29/275 |

*Primary Examiner*—Robert C. Watson
*Attorney, Agent, or Firm*—Leon Gilden

[57] ABSTRACT

A brake tool member is arranged for ease of impacting of a spring retainer clip structure relative to a brake cylinder for securement to a brake backing plate structure typically in an automotive environment. The structure includes an elongate handle coaxially aligned with a forwardly extending shank. A support flange orthogonally mounted to a forward distal end of the shank mounts a plurality of first and second mounting flanges, with the mounting flanges each including a semicylindrical ring segment arranged for positioning for abutment to the securement clip of the brake structure.

2 Claims, 4 Drawing Sheets

BRAKE TOOL

BACKGROUND OF THE INVENTION

1. Field of the Invention

The field of invention relates to brake tool structure, and more particularly pertains to a new and improved brake tool wherein the same is arranged for ease of positioning of the structure relative to an associated mounting clip of a wheel cylinder apparatus.

2. Description of the Prior Art

Brake tool structure of various types is utilized throughout the prior art for ease of the assembly of brake components to a backing plate structure of an automotive environment. Such apparatus is exemplified in U.S. Pat. No. 4,063,342 to Mitchell; U.S. Pat. No. 4,870,737 to Navarro; and U.S. Pat. No. 3,841,176 to Murphy. The U.S. Pat. No. 4,227,594 to Kleger sets forth a backing plate wheel cylinder retaining clip of a type for securement of a wheel cylinder to a backing plate structure of an automotive environment.

The instant invention attempts to overcome deficiencies of the prior art by providing for a unitary tool structure arranged for abutment to and for permitting subsequent impacting of a retaining clip relative to a wheel cylinder and in this respect, the present invention substantially fulfills this need.

SUMMARY OF THE INVENTION

In view of the foregoing disadvantages inherent in the known types of brake tool apparatus now present in the prior art, the present invention provides a brake tool wherein the same is arranged to orient a plurality of semi-cylindrical ring segments in abutment with a retainer clip for impacting of the retaining clip onto a wheel cylinder. As such, the general purpose of the present invention, which will be described subsequently in greater detail, is to provide a new and improved brake tool which has all the advantages of the prior art brake tool and none of the disadvantages.

To attain this, the present invention provides a brake tool member arranged for ease of impacting of a spring retainer clip structure relative to a brake cylinder for securment to a brake backing plate structure typically in an automotive environment. The structure includes an elongate handle coaxially aligned with a forwardly extending shank. A support flange orthogonally mounted to a forward distal end of the shank mounts a plurality of first and second mounting flanges, with the mounting flanges each including a semi-cylindrical ring segment arranged for positioning for abutment to the securement clip of the brake structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved brake tool which has all the advantages of the prior art brake tools and none of the disadvantages.

It is another object of the present invention to provide a new and improved brake tool which may be easily and efficiently manufactured and marketed.

It is a further object of the present invention to provide a new and improved brake tool which is of a durable and reliable construction.

An even further object of the present invention is to provide a new and improved brake tool which is susceptible of a low cost of manufacture with regard to both materials and labor, and which accordingly is then susceptible of low prices of sale to the consuming public, thereby making such brake tools economically available to the buying public.

Still yet another object of the present invention is to provide a new and improved brake tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
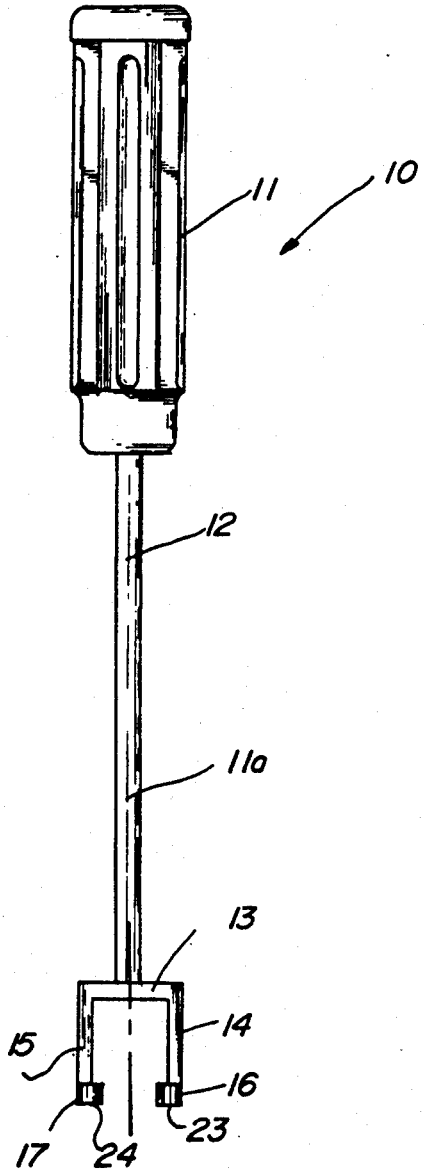
FIG. 1 is an orthographic view, taken in elevation, of the invention.
Figure 2:
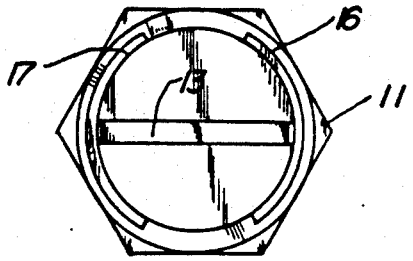
FIG. 2 is an orthographic end view of the instant invention.
Figure 3:
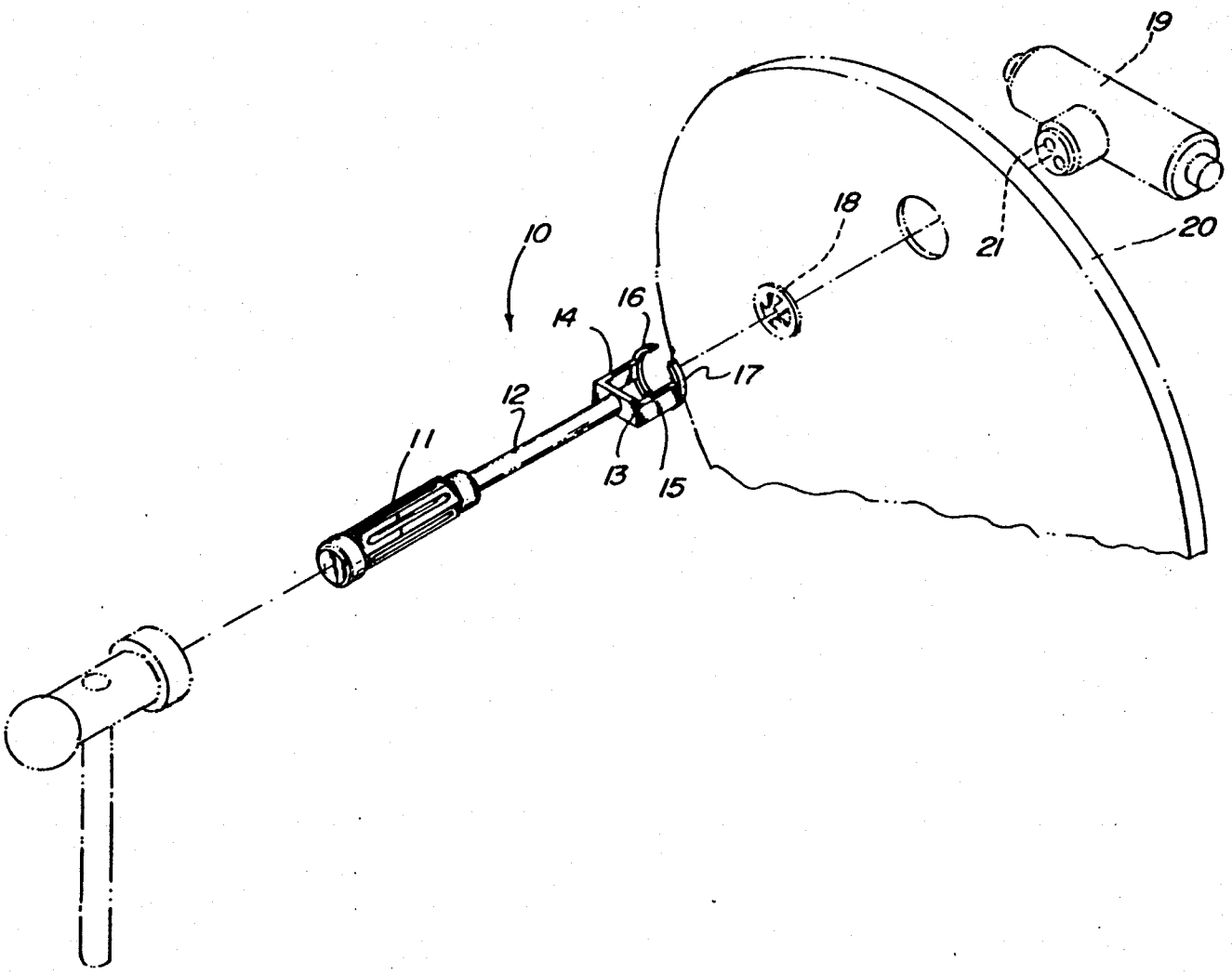
FIG. 3 is an isometric illustration of the invention in use.

With reference now to the drawings, and in particular to FIGS. 1 to 8 thereof, a new and improved brake tool embodying the principles and concepts of the present invention and generally designated by the reference numeral 10 will be described.

More specifically, the brake tool 10 of the instant invention essentially comprises an elongate handle 11 integrally mounted to an elongate shank 12 in a coaxially aligned relationship, with the shank 12 extending beyond the handle 11 and including a support flange 13 integrally and orthogonally mounted to a forward distal end spaced from the handle. Respective first and second mounting flange 14 and 15 are orthogonally and fixedly mounted to the support flange 13 and projecting forwardly thereof terminating in respective first and second semi-cylindrical ring segments 16 and 17 defined about a single axis coaxial with the axis 11*a* of the handle 11 and the shank 12. The first and second ring segments 16 and 17 include respective planar first and second respective abutment surfaces 23 and 24 that are coplanar relative to one another.

In use, the first and second abutment surfaces 23 and 24 are positioned in abutment with a brake cylinder clip 18 internally of a circular configuration arranged for impacting the clip onto a wheel cylinder boss 21 of an associated brake wheel cylinder 19, with the boss 21 directed through an opening of a brake support flange 20.

Figure 4:
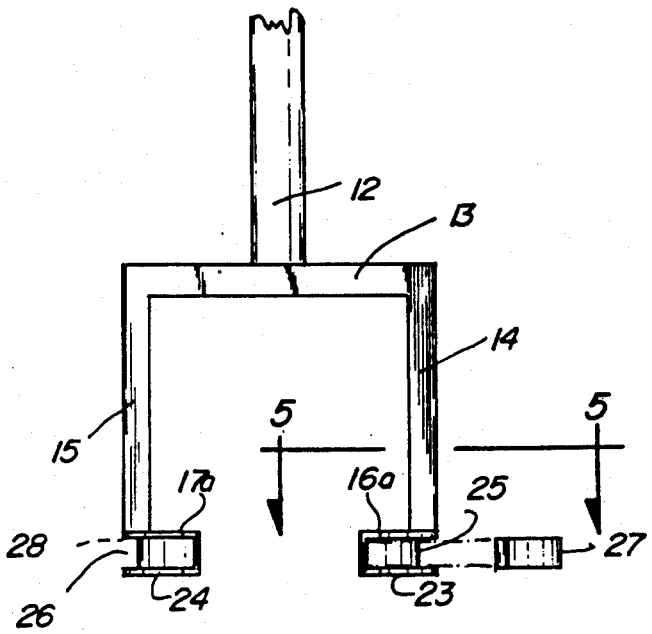
FIG. 4 is an orthographic view of a modified tool head structure of the invention.
Figure 6:
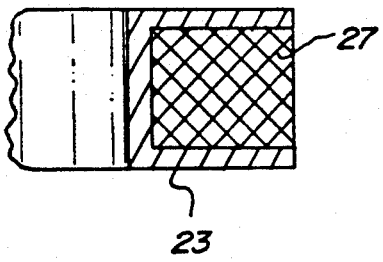
FIG. 6 is an orthographic view, taken along the lines 6—6 of FIG. 5 in the direction indicated by the arrows.
Figure 5:
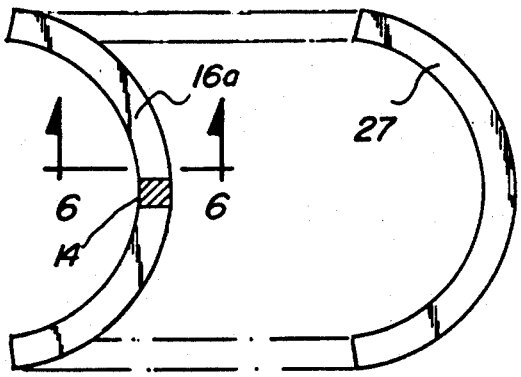
FIG. 5 is an orthographic view, taken along the lines 5—5 of FIG. 4 in the direction indicated by the arrows.
Figure 8:
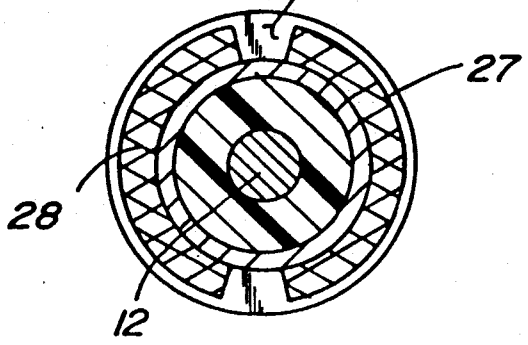
FIG. 8 is an orthographic view, taken along the lines 8—8 of FIG. 7 in the direction indicated by the arrows.
Figure 7:
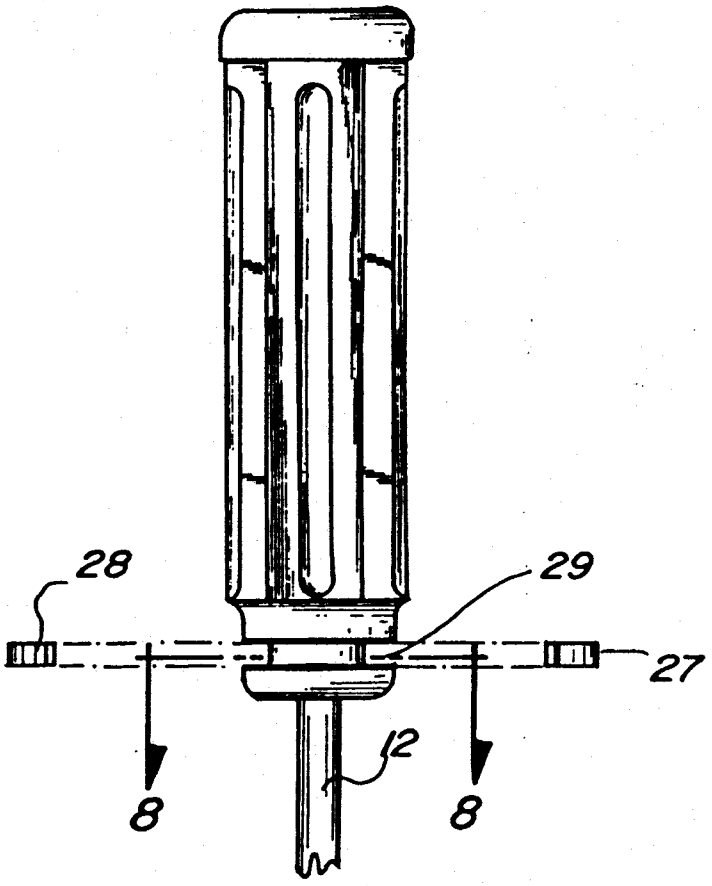
FIG. 7 is a modified aspect of the handle structure of the invention.

The apparatus of the FIG. 4 illustrates the use of modified first and second semi-cylindrical ring segments 16*a* and 17*a* that include respective semi-cylindrical first and second grooves 25 and 26 directed into the modified ring segments from an exterior surface thereof to receive respective first and second semi-cylindrical magnets 27 and 28 therewithin to permit for selective securement and magnetic adherence of the clip 18 to the abutment surfaces 23 and 24 in use. During periods of non-use and for storage of the magnets, the handle 11 includes a cylindrical handle groove 29 directed into the handle adjacent the shank 12 for storage of the first and second semi-cylindrical magnets 27 and 28.

It should be noted that the ring segments 16 and 17 each define an arc greater than ninety degrees and less than one hundred eightly degrees to define gaps therebetween for ease of manual manipulation and positioning of a cylindrical clip 18 onto the abutment surface 23 and 24.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A brake tool, comprising, an elongate handle, the handle including an elongate shank integrally mounted to the handle extending forwardly thereof, with the shank and the handle coaxially aligned along a single axis, and a support flange orthogonally and integrally mounted to a forward distal end of the shank spaced from the handle, the support flange including a first and second distal end spaced on opposed sides of the shank, with the first distal end having a first mounting flange integrally and orthogonally mounted to the support flange projecting forwardly of the support flange, with a second mounting flange arranged in a parallel spaced relationship relative to the first mounting flange integrally mounted to the second distal end, and a first semi-cylindrical ring segment integrally mounted to the first mounting flange, and a second semi-cylindrical ring segment mounted to the second mounting flange, with the first and second semi-cylindrical ring segments concentric relative to one another and coaxially aligned about the axis, and the first ring segment includes a planar first abutment surface, and the second ring segment includes a planar second abutment surface, wherein the first abutment surface and the second abutment surface are arranged in a coplanar relationship about a single plane, and the single plane orthogonally oriented relative to the axis, and the first ring segment includes a semi-cylindrical first groove and the second ring segment includes a semi-cylindrical second groove, wherein the first groove and the second groove are coaxially aligned about the axis, and a first semi-cylindrical magnet and a second semi-cylindrical magnet, with the first semi-cylindrical magnet magnetically received within the first groove, and the second semi-cylindrical magnet received within the second groove for magnetic adherence of a brake clip to the first abutment surface and the second abutment surface.

2. A tool as set forth in claim 1 wherein the handle includes a cylindrical handle groove directed into the handle adjacent the shank, the handle groove formed of a ferrous material for magnetic adherence of the first semi-cylindrical magnet and the second semi-cylindrical magnet for storage thereof.

* * * * *